US010561248B2

(12) United States Patent
Grove

(10) Patent No.: US 10,561,248 B2
(45) Date of Patent: Feb. 18, 2020

(54) ADJUSTABLE BACK SUPPORT ASSEMBLY FOR THE BACK OF A CHAIR

(71) Applicant: James E. Grove, Marina Del Rey, CA (US)

(72) Inventor: James E. Grove, Marina Del Rey, CA (US)

( * ) Notice: Subject to any disclaimer, the term of this patent is extended or adjusted under 35 U.S.C. 154(b) by 0 days.

(21) Appl. No.: 16/008,709

(22) Filed: Jun. 14, 2018

(65) Prior Publication Data

US 2018/0289164 A1 Oct. 11, 2018

Related U.S. Application Data

(62) Division of application No. 15/141,009, filed on Apr. 28, 2016, now Pat. No. 10,021,985.

(51) Int. Cl.
*A47C 7/46* (2006.01)

(52) U.S. Cl.
CPC ..... *A47C 7/467* (2013.01); *A47C 7/462* (2013.01)

(58) Field of Classification Search
CPC ..... A47C 7/467; A47C 7/462; A47C 7/46; A47C 7/465; A47C 7/48; A47C 7/40; A47C 7/44; A47C 7/446; A47C 1/0244; A47C 1/03216; B60N 2/665; B60N 2/666; B60N 2/667; B60N 2/6671; B60N 2/914; B60N 2/525
USPC ..... 297/284.4
See application file for complete search history.

(56) References Cited

U.S. PATENT DOCUMENTS 272,579 A * 2/1883 Paulding ..... A47C 7/44 297/291
3,938,858 A * 2/1976 Drabert ..... A47C 7/46 297/284.4
3,948,558 A * 4/1976 Obermeier ..... A47C 7/462 297/284.4
4,153,293 A * 5/1979 Sheldon ..... B60N 2/667 297/230.14
4,601,514 A * 7/1986 Meiller ..... A47C 7/462 297/284.4
5,174,526 A * 12/1992 Kanigowski ..... B60N 2/6671 244/118.5
5,249,839 A * 10/1993 Faiks ..... A47C 1/03255 297/284.4
5,718,476 A * 2/1998 De Pascal ..... A47C 7/462 297/284.1
5,725,276 A * 3/1998 Ginat ..... A47C 1/0325 297/289

(Continued)

*Primary Examiner* — Kyle J. Walraed-Sullivan
(74) *Attorney, Agent, or Firm* — Morland C. Fischer

(57) ABSTRACT

An adjustable back support assembly coupled to the back of a chair in which a user sits with his back spaced from the chair back. The adjustable back support assembly includes a back support that is pivotally connected to the back of the chair by a hinge. The back support is rotatable at the hinge away from the chair back and towards the back of the user to provide support thereto. The back support assembly also includes a gas cylinder having a retractable piston. The gas cylinder is connected between the back support of the adjustable back support assembly and an upstanding rigid chair backing within the back of the chair. When the retractable piston is forced outwardly from the gas cylinder, a linear pushing force is correspondingly generated by the piston to cause the back support to rotate away from the chair back and towards the back of the user.

6 Claims, 7 Drawing Sheets

(56) References Cited

U.S. PATENT DOCUMENTS 5,975,632 A * 11/1999 Ginat ..... A47C 7/462 297/284.4
6,419,318 B1 * 7/2002 Albright ..... A47C 7/462 297/284.4
6,672,669 B2 * 1/2004 Chu ..... A47C 1/03 297/301.1
7,475,943 B1 * 1/2009 Huang ..... A47C 7/405 297/284.4
8,272,691 B2 * 9/2012 Hsuan-Chin ..... A47C 7/46 297/284.4
8,696,064 B2 * 4/2014 Pan ..... A47C 7/443 297/284.4
8,857,908 B2 * 10/2014 Brncick ..... B60N 2/0232 297/284.1
9,358,911 B2 * 6/2016 Brncick ..... B60N 2/643
9,687,079 B1 * 6/2017 Grove ..... A47C 7/445
2003/0055365 A1 * 3/2003 Hazard ..... A47C 3/0255 601/98
2004/0124679 A1 * 7/2004 Teppo ..... A47C 7/462 297/284.4
2005/0151400 A1 * 7/2005 Liu ..... A47C 7/40 297/230.13
2008/0179930 A1 * 7/2008 Harley ..... A47C 7/46 297/284.7
2008/0231095 A1 * 9/2008 Brauning ..... A47C 7/38 297/219.1
2009/0079245 A1 * 3/2009 Marcantoni ..... A47C 7/465 297/284.4
2009/0146476 A1 * 6/2009 Kan ..... A47C 1/03255 297/284.4
2011/0285190 A1 * 11/2011 Wu ..... A47C 7/402 297/285
2012/0007399 A1 * 1/2012 Jaranson ..... B60N 2/66 297/284.4
2013/0020849 A1 * 1/2013 Hsuan-Chin ..... A47C 7/44 297/307
2014/0203599 A1 * 7/2014 Line ..... B60N 2/5642 297/180.14
2014/0203603 A1 * 7/2014 Line ..... B60N 2/64 297/218.1
2014/0203610 A1 * 7/2014 Line ..... B60N 2/2222 297/354.1
2015/0145303 A1 * 5/2015 Line ..... B60N 2/643 297/283.3
2015/0272333 A1 * 10/2015 Zouzal ..... B60N 2/66 297/284.7
2015/0272334 A1 * 10/2015 Gloeckl ..... A47C 7/443 297/284.7
2017/0158084 A1 * 6/2017 Line ..... B60N 2/0232

* cited by examiner

ADJUSTABLE BACK SUPPORT ASSEMBLY FOR THE BACK OF A CHAIR

CROSS REFERENCE TO RELATED APPLICATIONS

This application is a division of patent application Ser. No. 15/141,009 filed Apr. 28, 2016.

BACKGROUND OF THE INVENTION

1. Field of the Invention

This invention relates to an adjustable back support assembly located adjacent and pivotally coupled to the back of a chair, such as that commonly found in a home or office in which a user is known to sit close to a work surface with his back spaced from the chair back. By pressing a push button, the user can cause a linear pushing force to be generated by which a curved back support of the back support assembly is rotated away from the chair back and into engagement with the user's back to provide support and comfort thereto.

2. Background Art

A wide variety of chairs have been used in an office or at home which enable a user to be seated next to a work surface at which to access any of a computer, a book, a writing pad, etc. which lays upon the work surface. On many occasions, where the user wishes to move closer to the work surface, he may find himself seated at the front in the chair such that his back is spaced from the back of the chair. In this case, the chair back will offer little or no support for the user's lower back throughout those times when the user is working close to the work surface. Consequently, the user's back posture may suffer, especially during long periods of work when the user leans forward in the chair. At the same time, the user may experience lower back pain and discomfort.

What would therefore be desirable is a chair which enables the user's lower back to be comfortably supported and a correct back posture to be maintained especially when the user is seated at the front of the chair with his back spaced from the back of the chair.

SUMMARY OF THE INVENTION

In general terms, an adjustable back support assembly is disclosed to be located adjacent and coupled to the back of a chair, such as that common to a home or office so that the lower back of a user seated on the chair next to a work surface (e.g., a desk or table) will be supported, especially at those times when the user's back is spaced from the chair back. The chair includes a base which holds a seat above the ground. The back of the chair includes a rigid (e.g. plywood) backing that stands upwardly from the seat and is covered with a cushion material. A pair of arms of the chair are located at opposite sides of the seat and connected between the seat and the back of the chair.

The adjustable back support assembly includes a back support that is preferably curved to conform to the shape of the user's back. The back support is also covered with a cushion material. The top of the curved back support, is pivotally connected to and cantilevered from the upstanding chair backing by means of a hinge. The bottom of the back support is free to rotate at the hinge away from the upstanding backing of the chair back and towards the back of the user seated in the chair. In one preferred embodiment, a first end of a gas cylinder is connected by an upper bracket to the top of the back support. The gas cylinder is received through a gas cylinder receiving slot formed in the back support and a gas cylinder attachment opening formed in the upstanding chair backing. A retractable piston at the opposite end of the gas cylinder is connected by a lower bracket to the upstanding chair backing.

A push button is mounted on one of the pair of arms of the chair to be accessed by the user seated in the chair. A sheathed gas cylinder control cable runs from the push button to the gas cylinder. When the push button is depressed, the gas cylinder control cable is pulled which causes the retractable piston to be forced outwardly from the gas cylinder by the gas with which the cylinder is filled. When the piston is forced outwardly from the gas cylinder, the curved back support of the adjustable back support assembly which is connected to the first end of the gas cylinder by the upper bracket is pushed away from the upstanding chair backing of the chair back. That is, a linear pushing force generated by the piston causes the back support to rotate at the hinge and move from a first position lying adjacent the chair backing to a second position lying adjacent the back of the user to provide support and comfort thereto.

Another adjustable back support assembly for a chair includes the back of the chair which is rotatable in opposite directions towards and away from the back of a user seated in the seat of the chair. The adjustable back support assembly also includes a pair of stationary back support ribs that extend from behind the chair back at the rear of the chair for connection to the chair below the seat. The top of the chair back is coupled to and cantilevered from the stationary back support ribs by means of a rotatable hinge extending therebetween.

One end of a gas cylinder is fixedly connected to the pair of stationary back support ribs, and a retractable piston at the opposite end of the gas cylinder is coupled to the rotatable hinge. A push button located at one of the arms of the chair is connected to the gas cylinder by a gas cylinder control cable. When the push button is depressed, the piston is forced outwardly from the gas cylinder so as to apply an upward pushing force against the hinge, whereby to cause the hinge to rotate upwardly relative to the back support ribs. The upward rotation of the hinge in response to the axial pushing force generated by the retractable piston of the gas cylinder causes a corresponding rotation of the back of the chair from a first position lying adjacent the stationary back support ribs to a second position lying adjacent the back of the user in order to provide support and comfort thereto.

DESCRIPTION OF THE PREFERRED EMBODIMENT

Figure 1:
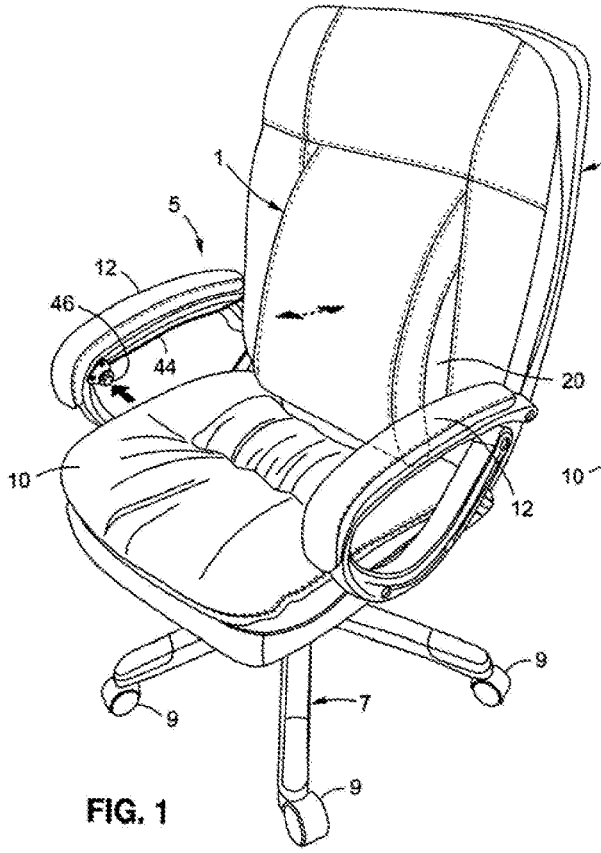
FIG. 1 shows a chair having a seat, a back, a pair of arms connected between the seat and the back, and an adjustable back support assembly according to a first preferred embodiment of this invention located adjacent the back of the chair.

A first embodiment for an adjustable back support assembly 1 for the back of a chair is disclosed while referring initially to FIGS. 1-7 of the drawings. The adjustable back support assembly 1 is located in front of the back 3 of a chair 5 of the kind that is commonly found in a home or office and located close to a work surface, such as a desk or table. The chair 5 has a base 7 which carries a plurality of rollers 9 that roll over a flat surface by which the chair can be moved from place to place. The base 7 of chair 5 holds a seat 10 above the ground. The seat 10 is pivotally coupled to the base 7 so as to be able to rock back and forth relative to the base when a user shifts his weight backwards and forwards. However, the adjustable back support assembly 1 of this invention need not be associated with a chair having a seat which pivots on a base.

The back 3 of chair 5 is connected to and extends upwardly from the seat 10 to receive and support the user's back thereagainst. A pair of arms 12 which are located at opposite sides of the seat 10 are connected between the back 3 and the seat 10 of the chair 5. Therefore, the back 3 and the seat 10 of the chair 5 will rock back and forth with one another when the user shifts his weight in the chair.

The back 3 of the chair 5 which lies behind the adjustable back support assembly 1 includes a generally, vertical, flat and rigid (e.g., plywood) upstanding chair backing 14. A (e.g., plywood) back support 16 of the back support assembly 1 is pivotally connected at the top thereof by means of a hinge 18 to the top of the upstanding chair backing 14 of the chair back 3. The bottom of the back support 16 is cantilevered downwardly from and rotatable at the hinge 18 between a first position lying adjacent the chair backing 14 of the chair back 3 of the chair 5 and a second position spaced forwardly and away from the chair backing 14. The back support 16 has a curved configuration to correspond with the shape of the back of the user.

Each of the upstanding chair backing 14 of the chair back 3 and the back support 16 of the adjustable back support assembly 1 is preferably surrounded by an inner cushion (e.g., foam) material (not shown) and then covered by an attractive upholstered material such as fabric, leather or the like. As is best shown in FIG. 1, with the cushioned and curved back support 16 at rest at its aforementioned first position lying adjacent the cushioned and flat chair backing 14 of the chair back 3, an air space or gap 20 (best shown in FIG. 1) is created between the chair backing 14 and the back support 16.

Figure 3:
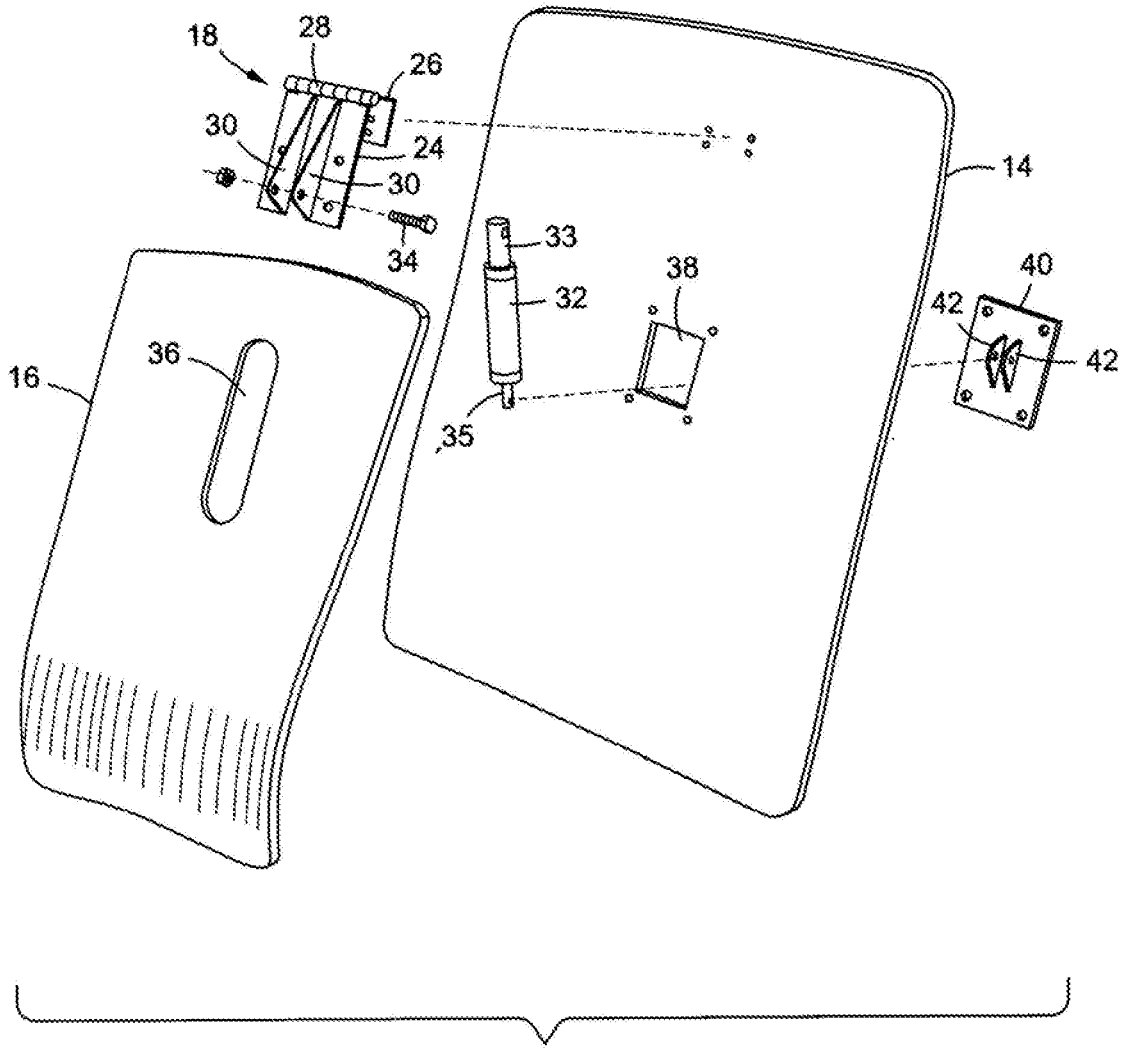
FIG. 3 is an exploded view of the adjustable back support assembly including a gas cylinder connected between the curved back support of the back support assembly and the upstanding chair backing of the chair back.

Details of the hinge 18 of the adjustable back support assembly 1 by which the top of the curved back support 16 is pivotally connected to and cantilevered from the upstanding chair backing 14 of the chair back 3 is described while referring to FIG. 3. By virtue of the hinge 18, the free bottom of the back support 16 is rotatable in opposite directions away from or towards the chair backing 14 to suit the needs and comfort of the user. That is to say, the user can selectively control the position of the curved back support 16 of the back support assembly 1 relative to the chair backing 14 depending upon the location of the user's back on the seat 10 of the chair 5.

The hinge 18 of support assembly 1 includes an upper bracket 24 that is connected by means of fasteners (designated 25 in FIG. 6) to the front of the back support 16. The hinge 18 also includes an L-shaped bracket extension 26 that is connected by fasteners (designated 27 in FIG. 6) to the front of the upstanding chair backing 14. The upper bracket 24 and the bracket extension 26 of hinge 18 are connected to one another by a coupling 28. In this manner, the upper bracket 24 can rotate at the coupling 28 relative to the bracket extension 26 and the upstanding chair backing 14 to enable the curved back support 16 to correspondingly rotate back and forth away from and towards the front of the chair backing 14.

A first pair of spaced, parallel aligned gas cylinder attachment arms 30 extend outwardly from the upper bracket 24 of the hinge 18. A first end 33 which extends outwardly from the body of a conventional gas cylinder 32 is fixedly connected between the gas cylinder attachment arms 30 of the upper bracket 24 by means of a fastener 34. An elongated, vertically extending gas cylinder receiving slot 36 is formed through the curved back support 16 of the adjustable back support assembly 1. The receiving slot 36 is sized to receive therethrough the gas cylinder 32, the first end 33 of which is connected between the first pair of gas cylinder attachment arms 30 of the upper bracket 24.

A gas cylinder attachment opening 38 is formed through the upstanding chair backing 14 of the chair back 3. A lower bracket 40 is connected to the rear of the chair backing 14. A second pair of spaced, parallel aligned gas cylinder attachment arms 42 extend outwardly from the lower bracket 40 and into the gas cylinder attachment opening 38. A retractable piston 35 that is located at the opposite end of the gas cylinder 32 and adapted to slide in and out of the body thereof is fixedly connected between the second pair of gas cylinder attachment arms 42 of the lower bracket 40 by means of a fastener (designated 43 in FIG. 6). It may therefore be appreciated, and as is best shown in FIG. 6, that the gas cylinder 32 extends between the upper bracket 24 of the hinge 18 that is mounted on the front of the back support 16 of the adjustable lumbar support assembly 1 and the lower bracket 40 that is mounted on the rear of the chair backing 14 of the chair back 3 by way of the gas cylinder receiving slot 36 that is formed in the lumbar support backing 16 and the gas cylinder attachment opening 38 that is formed in the chair backing 14.

Figure 4:
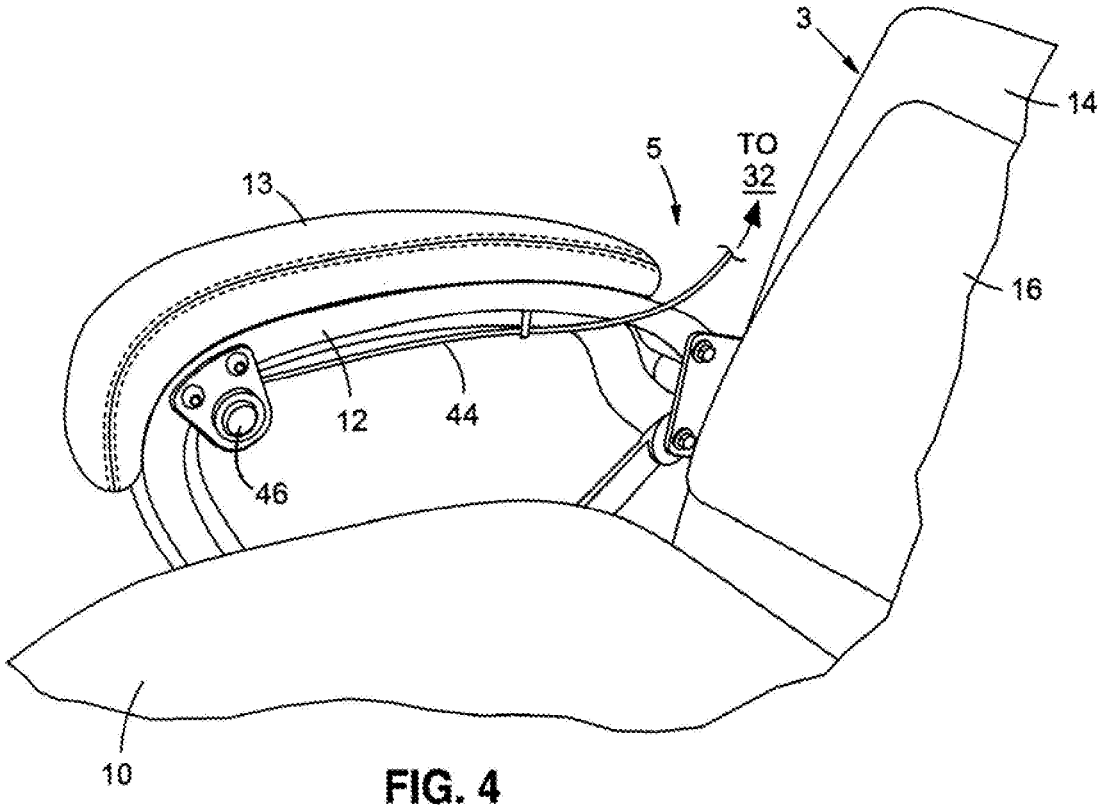
FIG. 4 shows a push button mounted at a first location on one of the pair of arms of the chair of FIG. 1 and a gas cylinder control cable extending between the push button and the gas cylinder of FIG. 3 so that a retractable piston is forced outwardly from the gas cylinder when the push button is depressed to cause a pushing force to be applied against the back support of the adjustable back support assembly to cause the back support to rotate away from the upstanding chair backing of the back of the chair.
Figure 5:
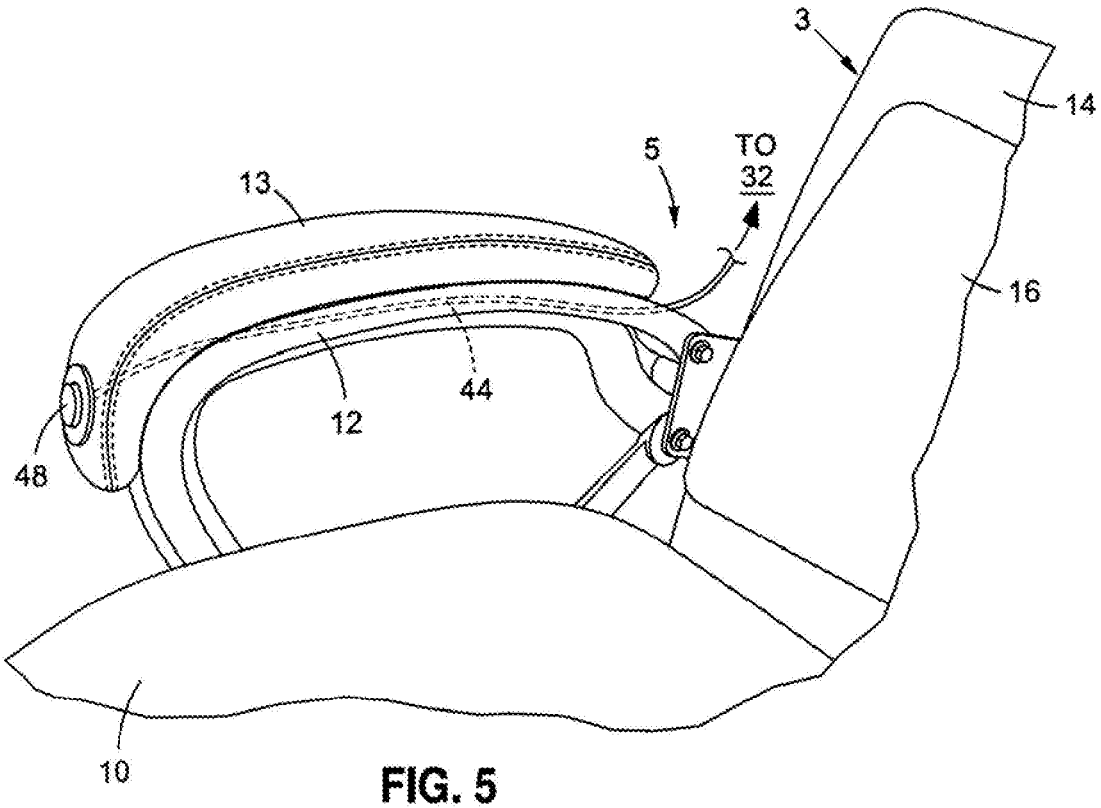
FIG. 5 shows the push button mounted at a different location on one of the pair of arms of the chair of FIG. 1 so that the retractable piston is forced outwardly from the gas cylinder when the push button is depressed.

Referring particularly to FIGS. 4-7 of the drawings, details are now provided to explain the ability of a user seated in the chair 5 to selectively control the position of the curved back support 16 of the adjustable back support assembly 1 relative to the back 3 of the chair 5 in order to enhance the user's comfort depending upon where on the seat 10 of the chair 5 the user is seated. To this end, a sheathed gas cylinder control cable 44 is shown in FIGS. 4 and 5 connected at one end thereof to a user-actuated push button.

In the case of FIG. 4, the push button 46 is mounted along one side of one arm 12 of the pair of arms of the chair 5, and the cable 44 runs below the arm 12 from the push button 46 to the gas cylinder 32 of FIGS. 6 and 7. In the case of FIG. 5, the push button 48 is embedded within the padding 13 which sits atop one arm 12 of the pair of arms of chair 5, and the cable 44 runs below the padding 13 from the push button 48 to the gas cylinder 32. However, it should be understood that the locations of the push button 46 or 48 and the gas cylinder control cable 44 are not to be considered a limitation to this invention so long as the push button is accessible to the user seated in the chair 5.

Figure 2:
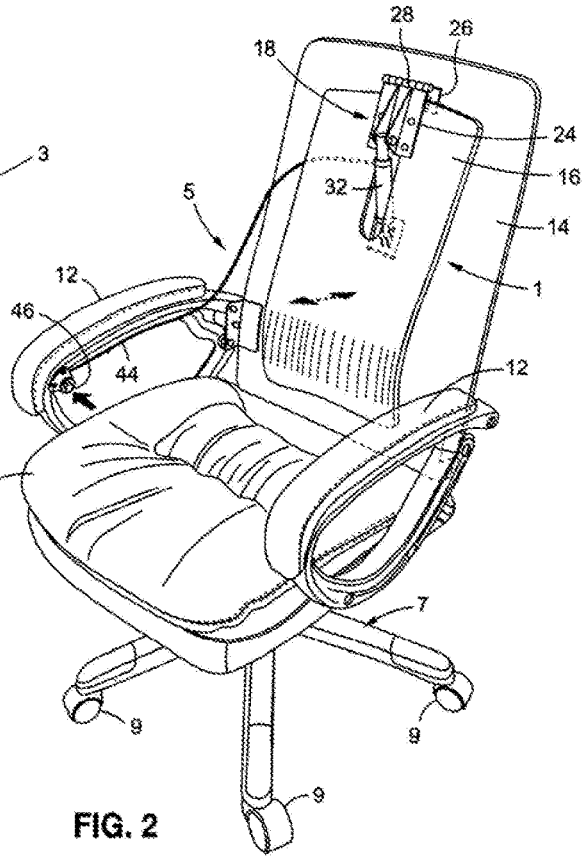
FIG. 2 shows a curved back support of the adjustable back support assembly of FIG. 1 pivotally coupled to an upstanding chair backing of the back of the chair of FIG. 1.
Figure 6:
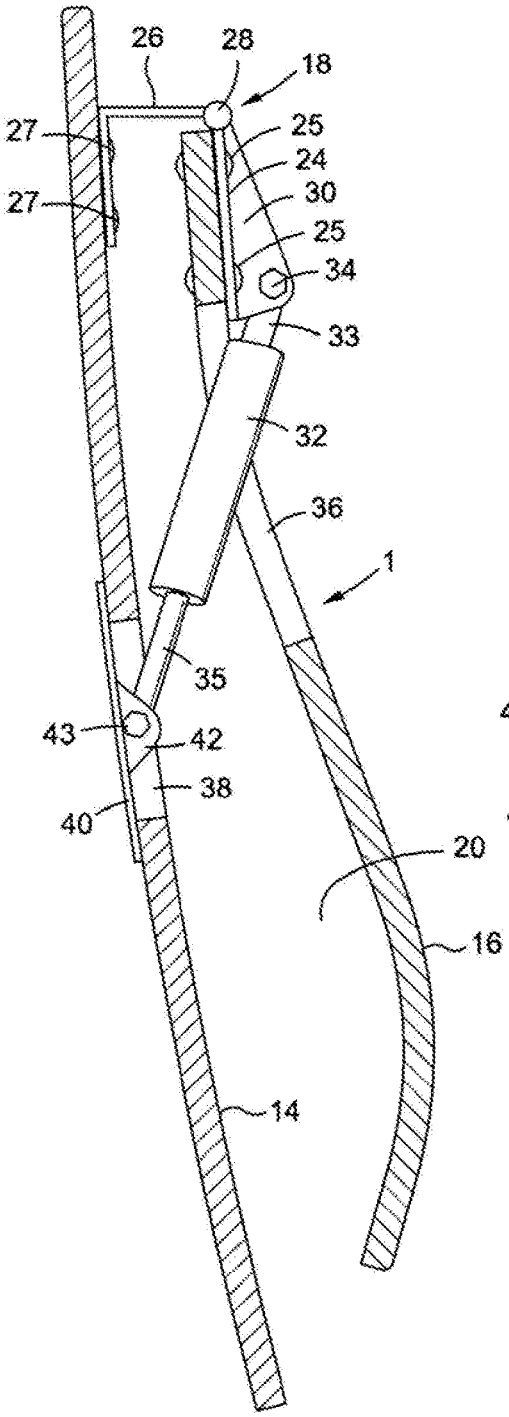
FIG. 6 shows the curved back support of the adjustable back support assembly lying at a first position adjacent the upstanding chair backing of the chair back prior to the push button of FIG. 4 or 5 being depressed.
Figure 7:
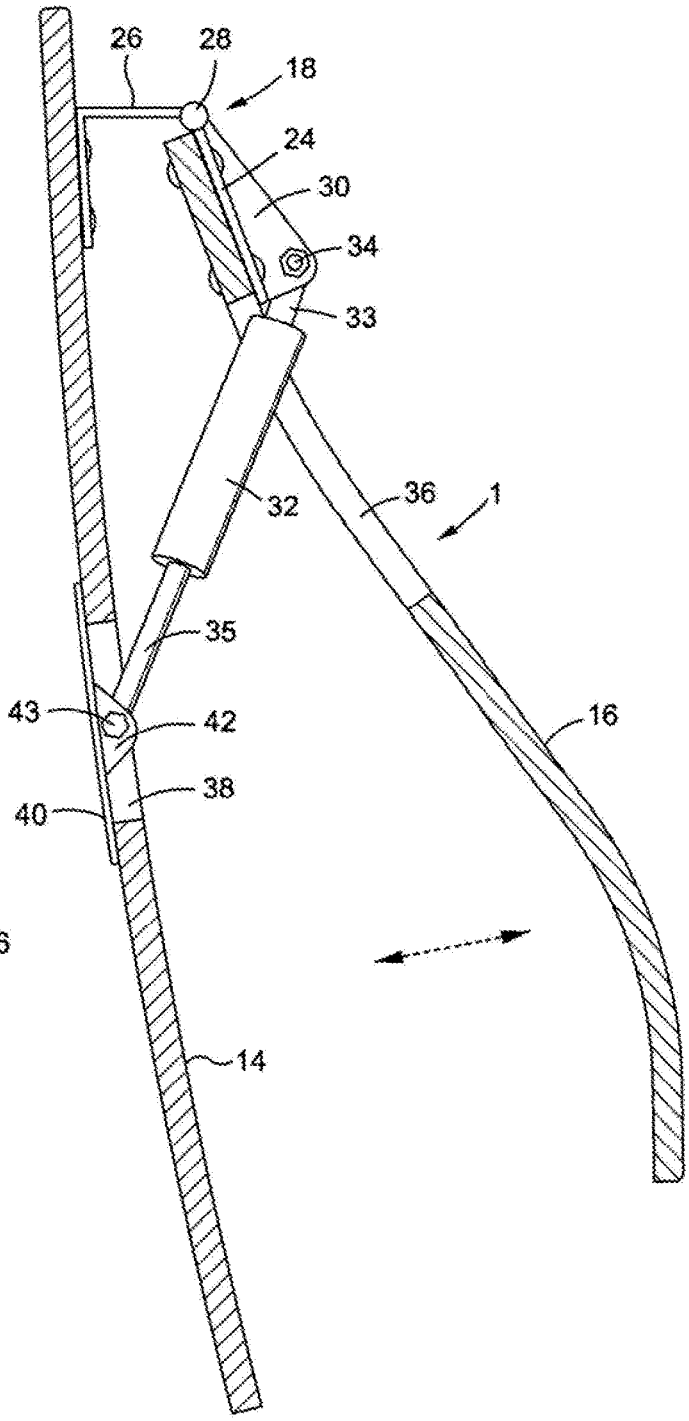
FIG. 7 shows the curved back support of the adjustable back support assembly rotated towards a second position away from the upstanding chair backing of the chair back after the push button of FIG. 4 or 5 is depressed.

FIG. 6 of the drawings shows the curved back support 16 of the adjustable back support 1 at rest at its first position lying adjacent the upstanding backing 14 in front of the back 3 of the chair 5 of FIGS. 1 and 2 before the push button (designated 46 in FIGS. 1 and 2) is depressed by the user. In this case, the retractable piston 35 is retracted inwardly of the body of the gas cylinder 32. With the piston 35 retracted in the manner shown in FIG. 6, the curved back support 16 which is connected to the first end 33 of the gas, cylinder 32 by the upper bracket 24 of hinge 18 is correspondingly held close to the chair backing 14 and to its aforementioned first position.

When the user is sitting in the chair 5 (of FIGS. 1 and 2) so that his back is spaced from the chair back 3 so as to lie towards the front of the chair seat 10, he can depress the push button 46 in order to actuate'the adjustable back support assembly 1 and thereby provide support and comfort to his back. In this case, and turning now to FIG. 7, the retractable piston 35 is forced outwardly from the body of the gas cylinder 32 when the push button 46 is depressed. The operation of the conventional gas cylinder 32 when the push button 46 is depressed is known and, therefore, only a brief description is provided.

A pushing force applied to push button 46 causes a corresponding pulling force to be applied to the sheathed gas cylinder control cable 44 (of FIGS. 1 and 2) which runs between the push button 46 and the gas cylinder 32. When the control cable 44 is pulled, the retractable piston 35, which is initially held in place within the body of the gas cylinder 32, is released. The pressure of the gas with which the body of the gas cylinder 32 is filled forces the piston 35 outwardly from the gas cylinder 32 in the manner shown in FIG. 7.

When the piston 35 is freed outwardly from the gas cylinder 32, the curved back support 16 of the adjustable back support assembly 1 which is connected to the first end 33 of the gas cylinder by the upper bracket 24 of the hinge 18 is now pushed away from the upstanding chair backing 14 of the chair back 3 to its second position spaced from the front of the chair back. That is, as the piston 35 is driven outwardly from the gas cylinder 32, a linear pushing force generated by the piston against the chair backing 14 causes the upper bracket 24 of the hinge 18 to rotate (in a counter-clockwise direction) at the coupling 28 of hinge 18. Because the upper bracket 24 is connected to the first end 33 of the gas cylinder 32 as well as to the top of the curved back support 16, the linear pushing force generated by the outwardly extending piston 35 is translated into a rotational movement of the cantilevered bottom of the back support 16 in the counter-clockwise direction away from the chair backing 14 and towards the back of the user who is seated with his back spaced from the back 3 of the chair 5 shown in FIGS. 1 and 2.

As previously described, and as is best shown in FIG. 1, the curved back support 16 of the adjustable back support assembly 1 is surrounded by a cushion material. When the cushioned back support 16 is rotated from its first position to its second position spaced from the chair back 3 and towards the user's back, the push button 46 is released and the rotation of the back support 16 is terminated. Thus, the user's back can now be comfortably supported by the curved back support 16 of the adjustable back support assembly 1.

In this regard, it may be appreciated that by depressing and holding the push button 46, the cushioned back support 16 of the adjustable back support assembly 1 can be selectively positioned to engage the user's back depending upon the position of the user seated in the chair 5. When the user wishes to move back in the chair 5 and rest his back directly against the chair back 3, he can either lean back so as to cause the back 3 and seat 10 of the chair to tilt backwards or he can use his hand to simply press against and generate a pushing force for causing the back support 16 to rotate at the coupling 28 of hinge 18 (in a clockwise direction) towards its first position lying adjacent the upstanding chair backing 14, whereby the retractable piston 35 will be retracted (i.e., pushed) inwardly of and once again held inside the body of the gas cylinder 32.

For the adjustable back support assembly 1 shown in FIGS. 1-7, the gas cylinder 32 is connected between the rear of the upstanding chair backing 14 of the chair back 3 and the front of the curved back support 16 of the back support assembly 1 at the top thereof. More particularly, the first end 33 of the gas cylinder 32 is connected by way of the gas cylinder receiving slot 36 to the front of the back support 16 by means of the upper bracket 24 of the hinge 18, and the retractable piston 35 at the opposite end of the gas cylinder 32 is connected by way of the gas cylinder attachment opening 38 to the rear of the chair backing 14 by means of the lower bracket 40.

Figure 8:
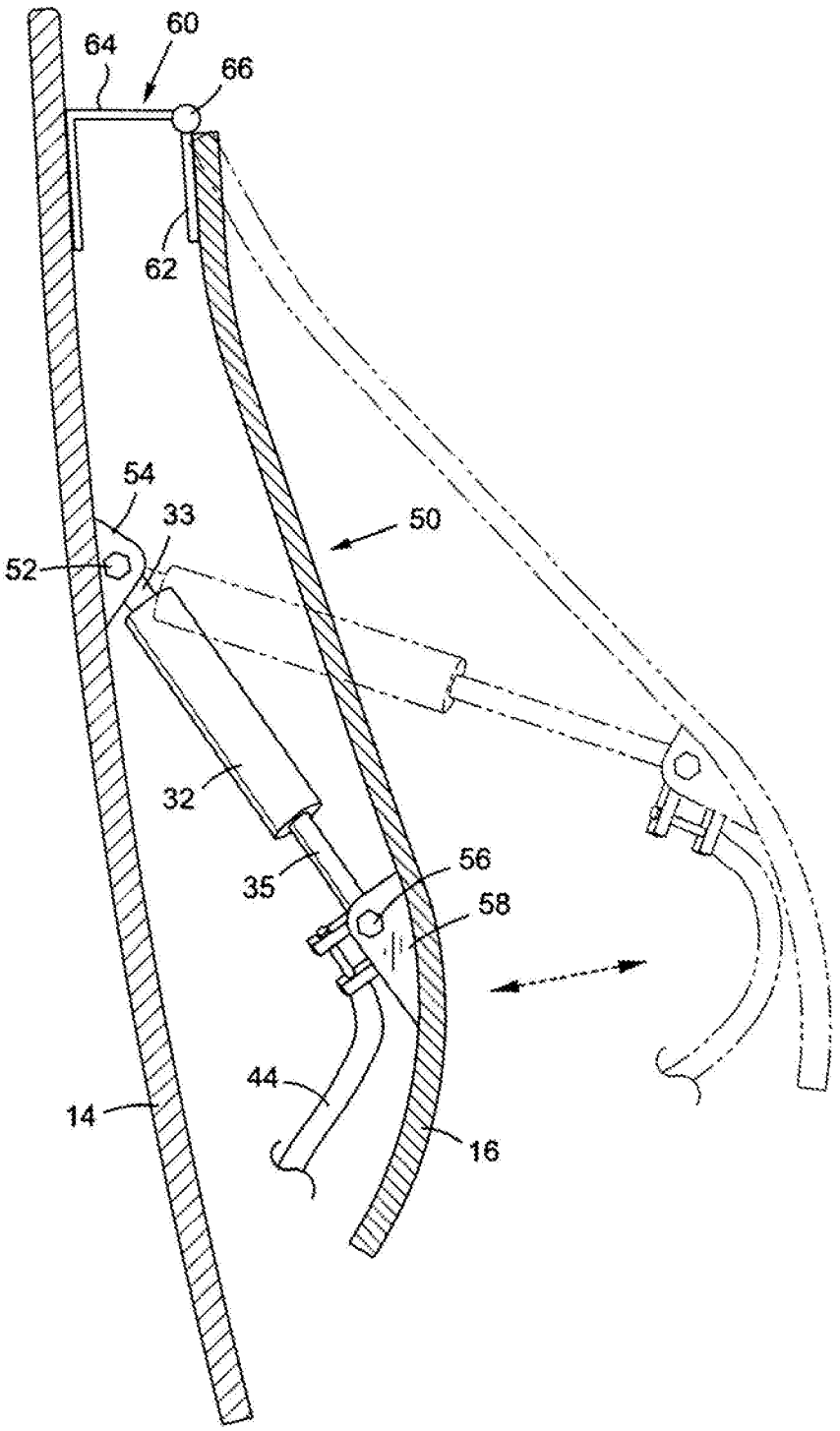
FIG. 8 shows an adjustable back support assembly according to a second preferred embodiment of this invention by which the curved back support of the back support assembly is rotated relative to and moved away from the upstanding chair backing of the back of the chair in FIG. 1 when the push button of FIG. 4 or 5 is depressed and a retractable piston is forced outwardly from a gas cylinder that is connected between the back support of the back support assembly and the upstanding chair backing of the chair back.

FIG. 8 of the drawings shows an alternate embodiment for an adjustable back support assembly 50 for the same chair 5 that is shown in and described while referring to FIGS. 1-7. For the adjustable back support assembly 50, the gas cylinder 32 is now connected between the front of the upstanding chair backing 14 of the chair back 3 and the opposing rear of the curved back support 16 of the back support assembly 50. More particularly, the first end 33 of the gas cylinder 32 is connected to a pivot pin 52 that extends between a first pair of gas cylinder attachment arms (only one of which 54 being shown). The first pair of gas cylinder attachment arms 54 are fixedly attached to the front of the upstanding chair backing 14.

The retractable piston 35 at the opposite end of the gas cylinder 32 is connected to a fastener 56 that extends between a second pair of gas cylinder attachment arms (only one of which 58 also being shown). The second pair of gas cylinder attachment arms 58 are fixedly attached to the opposing rear of the back support 16 at the bottom thereof, such that the first and second pairs of gas cylinder attachment arms 54 and 58 lie one above the other and facing one another.

The hinge 18 (best shown in FIGS. 6 and 7) of the earlier described adjustable back support assembly 1 of FIGS. 1-7 is simplified in the adjustable back support assembly 50 shown in FIG. 8. In this case, a hinge 60 of the back support assembly 50 is connected between the front of the upstanding chair backing 14 and the opposing rear of the back support 16 at the top thereof. The hinge 60 includes a flat hinge plate 62 that is affixed to the rear of the back support 16 above the second pair of gas cylinder attachment arms 58. The hinge 60 also includes an L-shaped hinge bracket 64 that is affixed to the opposing front of the upstanding chair backing 14 above the first pair of gas cylinder attachment arms 54. The flat hinge plate 62 of hinge 60 is connected to the L-shaped hinge bracket 64 by means of a coupling 66 located therebetween.

The operation of the adjustable back support assembly 50 of FIG. 8 is substantially the same as the operation of the adjustable back support assembly 1 of FIGS. 1-7. In particular, a user who is seated on the seat 10 with his back spaced from the back 3 of the chair 5 shown in FIGS. 1 and 2 depresses the push button 46 which is connected to the gas cylinder 32 by means of the sheathed gas cylinder control cable 44.

Depressing the push button 46 results in the piston 35 being forced outwardly from the body of the gas cylinder 32 and applying a corresponding pushing force against the curved back support 16 of the adjustable back support assembly 50. The free bottom of the cantilevered'back support 16 will in turn rotate (in a counter-clockwise direction) at the coupling 66 of the hinge 60 from its aforementioned first position as shown lying adjacent the front of the upstanding chair backing 14 to its aforementioned second position (shown in phantom lines) moved away and spaced from the chair backing 14. At the same time, the first end 33 of the gas cylinder 33 will rotate at the pivot pin 52 that extends between the first pair, of gas cylinder attachment arms 54, such that the linear pushing force generated by the outwardly extending piston 35 is translated into a rotational movement of the curved back support 16 of the cushioned back support assembly 50 towards and into engagement with the user's back to provide support and comfort thereto.

FIGS. 1-8 of the drawings, an adjustable back support assembly 1 is shown for the back 3 of the chair 5 wherein a curved back support 16 of the back support assembly 1 is caused to move relative to the chair back 3 by means of a gas cylinder 32. FIGS. 9-13 of the drawings show another chair 70 (best shown in FIG. 9) having a back 72, a rigid seat 74, a pair of padded arms 75 connected to opposite sides of the seat 74, a seat support base 76 with rollers 78, and an adjustable back support assembly 80. In the case of the adjustable back support assembly 1, the curved back support 16 rotates away from the chair back 3 and toward the back of the user. In the case of the adjustable back support assembly 80 of the chair 70 shown in FIGS. 9-13, the entire back 72 of the chair rotates towards the user's back to, provide support thereto.

The rotatable back 72 of the chair 70 includes a rigid frame 82 that surrounds a mesh backing 84 against which the back of a user is comfortable supported. However, the chair back 72 can be uniformly rigid, and the mesh backing 84 may be eliminated. The chair back 72 has a curved configuration to conform to the shape of the back of the user.

The adjustable back support assembly 80 of the chair 70 includes the rotatable back 72 that is located in front of a pair of curved, stationary back support ribs 86 that are spaced from one another. Upper ends of the back support ribs 86 are coupled to and hold the chair back 72 at the rear of the chair 70 so as to stand upwardly above the seat 74. An attachment plate 88 (best shown in FIG. 10) extends between the opposite lower ends of the stationary back support ribs 86. The back support ribs 86 curve below the rigid seat 74, and the attachment plate 88 is affixed by fasteners (not shown) to the bottom of the seat 74.

The upper ends of the spaced back support ribs 86 are connected to a hollow threaded cylindrical coupler 90 by means of threaded fasteners (e.g., bolts) 92. The threaded coupler 90 is positioned between the support ribs 86, and the threaded fasteners 92 are inserted through holes 93 that are formed in the support ribs and axially aligned with the hollow coupler 90 so that the cylindrical couplet is rotatable between and relative to the pair of stationary bad support ribs 86.

Figure 11:
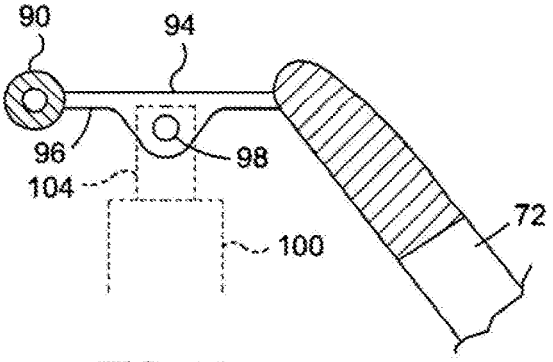
FIG. 11 is an enlarged detail of a portion of the adjustable back support assembly to illustrate the rotatable nature of the back of the chair.

As is best shown in FIG. 11, the cylindrical coupler 90 that is rotatable between the back support ribs 86 is connected to the rear of the chair back 72 at the top thereof by way of a hinge 94 that extends between coupler 90 and chair back 72. The hinge 94 includes a pair of spaced, parallel aligned attachment arms 96 that are affixed (e.g., welded) at opposite ends thereof to the chair back 72 and to the cylindrical coupler 90. A pair of axially aligned holes (only one of which 98 being shown) are formed through respective ones of the pair of attachment arms 96 of the hinge 94.

A conventional gas cylinder 100 of the adjustable back support assembly 80 is connected to the hinge 94 to apply a linear pushing force thereto to cause a corresponding rotation of the back 72 of the chair 70 relative to the pair of stationary back support ribs 86 towards and away from the back of a user seated in the chair. The gas cylinder 100 shown in FIGS. 9-13 may be identical to the gas cylinder 32 that was previously described while referring to FIGS. 1-8. Thus, the gas cylinder 100 has a body, a fixed end 102 extending outwardly from one end of the body, and a retractable piston 104 that is slideable in and out of the opposite end of the body. A sheathed gas cylinder control cable 106 runs from the body of the gas cylinder 100 to a user-activated push button 108 that is mounted atop one of the pair of the arms 75 of the chair 70 (best shown in FIG. 9).

A gas cylinder fixation plate 110 is connected between the pair of stationary back support ribs 86 behind the back 72 of the chair 70. A hole is formed through the gas cylinder fixation plate 110, and the fixed end 102 of the gas cylinder 100 is pushed through the hole and fastened to the fixation plate 110, such that the gas cylinder 100 stands upwardly from fixation plate 110. A hole 112 (best shown in FIG. 10) is formed through the retractable piston 104 of the gas cylinder 100. The piston 104 is located between the attachment arms 96 of the hinge 94 so that the bole 112 through piston 104 is axially aligned with the holes 98 through respective attachment arms 96. A fastener (not shown) is inserted through the axially aligned holes 98 and 112 so that the piston 104 of the gas cylinder 100 is attached to the hinge 94 between the attachment arms 96 thereof.

Figure 12:
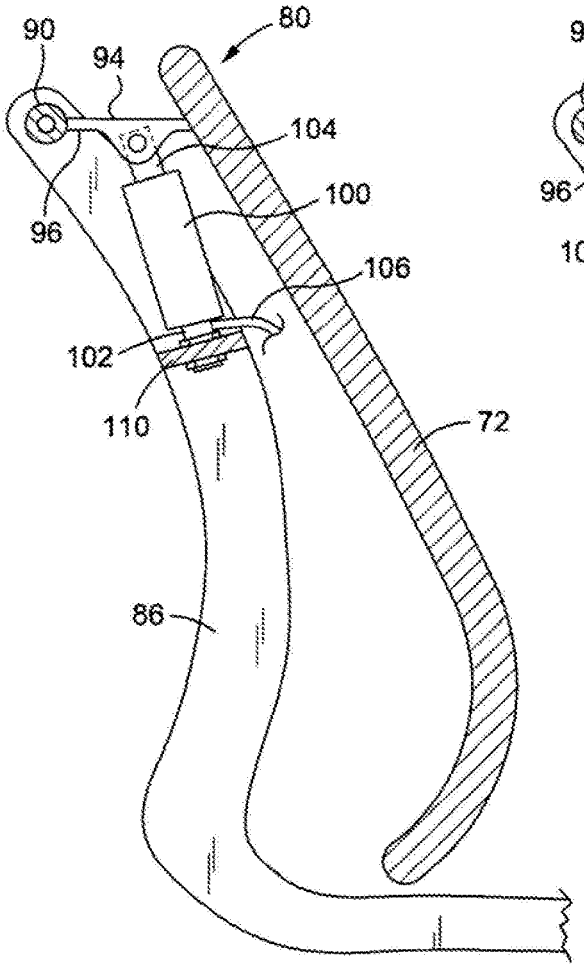
FIG. 12 shows the chair back of the adjustable back support assembly of FIG. 9 lying at a first position adjacent a stationary back support at the rear of the chair behind the seat.
Figure 13:
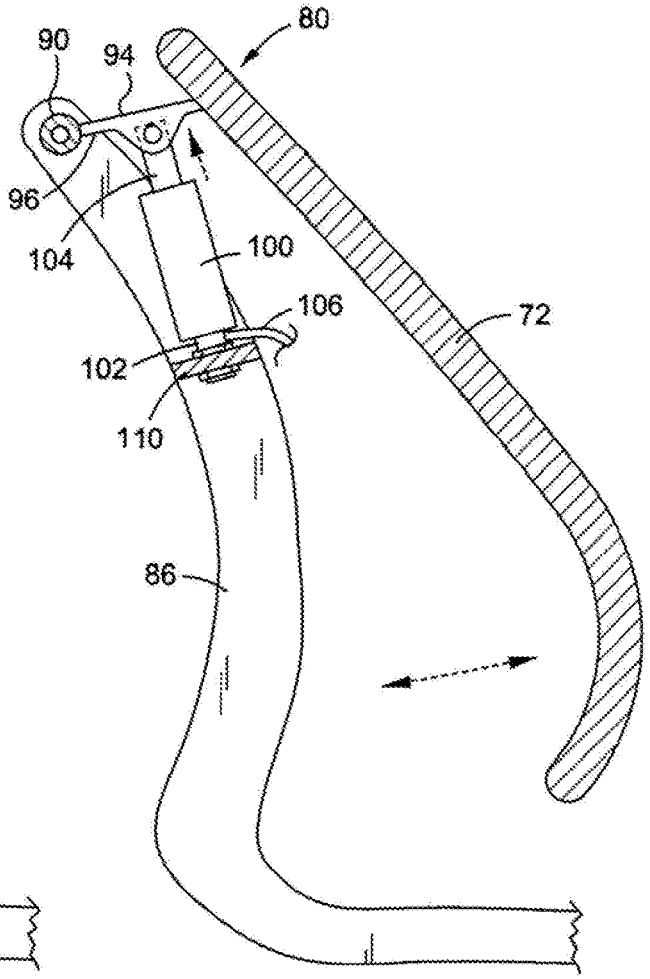
FIG. 13 shows the chair back of the adjustable back support assembly rotated to a second position away from the stationary back support and towards the back of the user.

FIGS. 12 and 13 of the drawings show the top of the curved back 72 of the adjustable back support assembly 80 of the chair 70 (of FIG. 9) connected by means of the hinge 94 to the cylindrical coupler 90 that extends between the stationary back support ribs 86. By virtue of the hinge 94, the cantilevered bottom of the chair back 72 is rotatable in opposite directions, back and forth, relative to the back support ribs 86 towards and away from the back of the user. Thus, as in the case of the chair 5 of FIGS. 1-8, and as will now be explained, a user seated in the chair 70 of FIG. 9 can selectively control the position of the curved rotatable chair back 72 to enhance his comfort and posture depending upon the location of the user's back in the chair.

FIG. 12 shows the rotatable chair back 72 at rest and lying at a first position adjacent the pair of stationary back support ribs 86 before the push button (designated 108 in FIG. 9) is depressed by the user. In this case, the retractable piston 104 is retracted inwardly of the body of the gas cylinder 100. That is, when the chair back 72 is rotated backwards and in a first direction toward its first position adjacent the back support ribs 86, the hinge 94 that is coupled to the retractable piston 104 is caused to rotate downwardly with the cylindrical coupler 90. Accordingly, the retractable piston 104 is pushed inside the body of gas cylinder 100.

When the user is seated in the chair 70 (of FIG. 9) so that his back is spaced from the chair back 72, he can depress the push button 108 in order to activate the adjustable back support assembly 80 and thereby provide support to his back. FIG. 13 shows the retractable piston 104 forced outwardly from the body of the gas cylinder 100 after the push button 108 is depressed and a pulling force is correspondingly applied to the sheathed gas cylinder control cable 106, whereby to cause the piston 104 to be released from inside the cylinder 100.

When the retractable piston 104 is released and forced outwardly from the gas cylinder 100, the hinge 94 is once again caused to rotate with the cylindrical coupler 90. In this case, however, the hinge 94 is pushed upwardly and away from the body of the gas cylinder 100. Because the top of the chair back 72 is connected to the cylindrical coupler 90 by way of the hinge 94, the upward rotation of the hinge 94 causes the cantilevered bottom of the chair back 72 to rotate forwards and in an opposite direction away from the stationary back support ribs 86 so as to move towards the back of the user seated in the chair. Thus, the curved chair back 72 is now located at a second position spaced ahead of the back support ribs 86 so as to engage the user's back.

Figure 9:
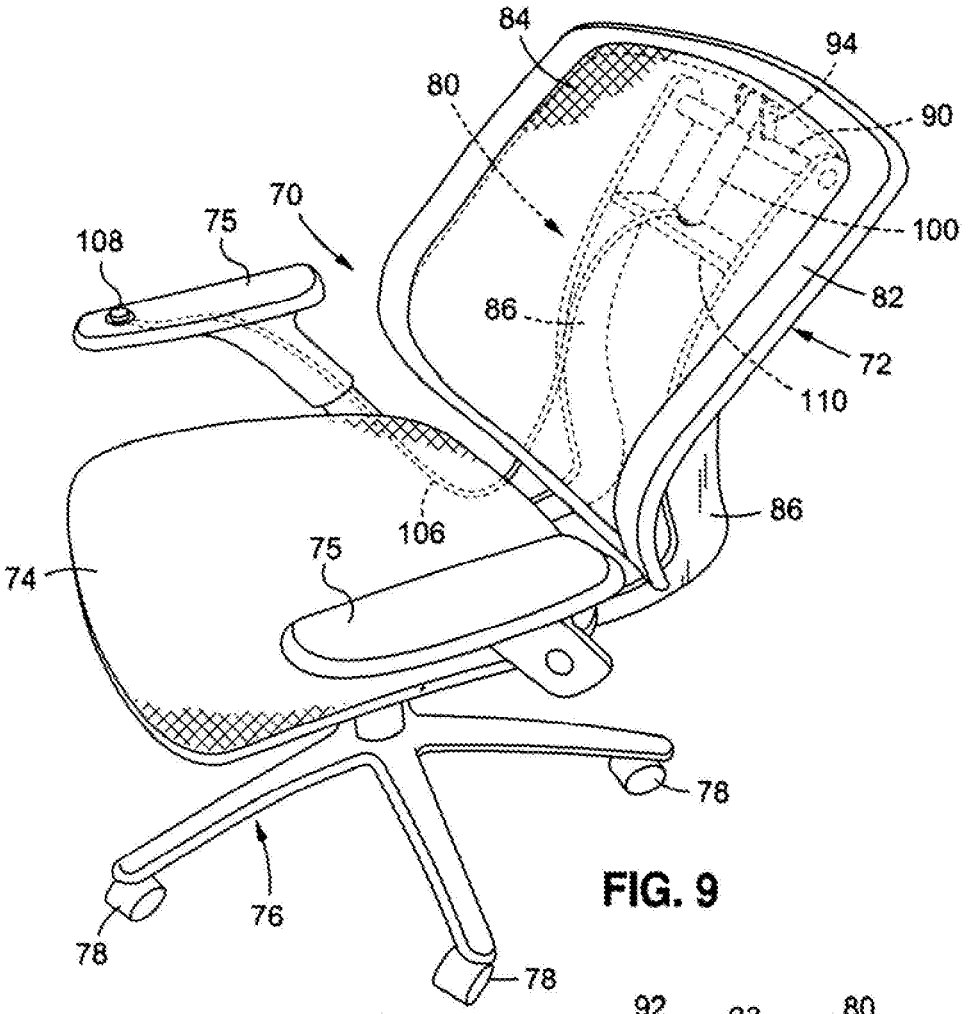
FIG. 9 shows a different chair having a seat, a pair of arms at opposite sides of the seat, and an adjustable back support assembly that includes the back of the chair according to another preferred embodiment of this invention by which the chair back is moved towards the back of a user seated in the chair.
Figure 10:
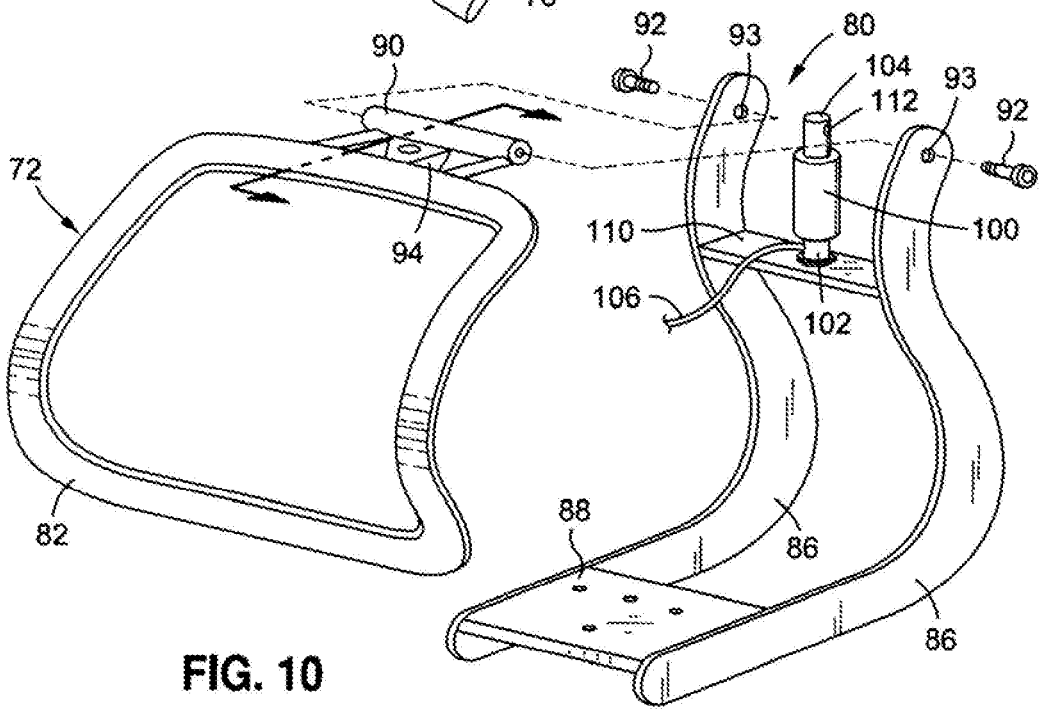
FIG. 10 is an exploded view of the adjustable back support assembly for the chair shown in FIG. 9.

The user can cause the rotatable back 72 of the chair 70 of FIG. 9 to return from its second position shown in FIG. 13 to its first position shown in FIG. 12 by either leaning back or using his hand to push the chair back 72 towards the stationary back support ribs 86, whereby to cause the chair back 72 to rotate with the hinge 94 and the cylindrical coupler 90 in the aforementioned first direction so as to once again lie adjacent the support ribs 86.

The invention claimed is:

1. A chair comprising:

a seat adapted to support the weight of a user seated in the chair;

a back standing upwardly above the seat against which the user can lean his back, the back of said chair having first and opposite ends;

a back support having first and opposite ends;

a coupler coupled to and rotatable relative to the first end of said back support;

a hinge extending between said coupler and the first end of said back, such that the first end of said back is pivotally connected to the first end of said back support by way of said hinge and said coupler, and the opposite end of said back support is connected to the seat to hold said back above said seat, said hinge being rotatable with said coupler relative to the first end of said back support; and a gas cylinder having first and opposite ends and a retractable piston, said retractable piston being located at the first end of said gas cylinder and connected to said hinge, and the opposite end of said gas cylinder being connected to said back support, the retractable piston of said gas cylinder moving between a retracted position inwardly of said gas cylinder and an extended position outwardly from said gas cylinder, said retractable piston moving from said retracted position to said extended position so as to generate a pushing force against said hinge for causing said binge to rotate with said coupler in a first direction relative to the first end of said back support and the opposite end of said back to rotate towards the back of the user, and said retractable piston moving to said retracted position by which to cause said hinge to rotate with said coupler in an opposite direction relative to the first end of said back support and the opposite end of said back to rotate away from the bark of the user, said back support comprising a pair of back support ribs that are spaced from one another and a fixation plate extending horizontally between said pair of back support ribs above said seat, the opposite end of said gas cylinder connected to said fixation plate such that said gas cylinder stands vertically upward from said horizontally extending fixation plate, and each of said back support and the opposite end of said gas cylinder remains stationary when the opposite end of said back rotates towards and away from the back of the chair.

2. The chair recited in claim 1, wherein said coupler is a cylinder connected to the first end of said back support so as to lie between and rotate relative to the pair of back support ribs thereof when the retractable piston of said gas cylinder moves between said retracted and said extended positions.

3. The chair recited in claim 1, wherein said fixation plate has a hole formed therein within which to receive the opposite end of said gas cylinder so that said gas cylinder is connected to said fixation plate at said hole.

4. The chair recited in claim 1, wherein the seat has a top and a bottom lying opposite said top, the opposite end of said back support being fixedly connected to said seat at the bottom thereof.

5. The chair recited in claim 1, wherein said hinge is pivotally connected to the retractable piston of said gas cylinder such that said hinge is rotatable with said coupler relative to said retractable piston.

6. The chair recited in claim 1, wherein said hinge is pivotally connected to the retractable piston of said gas cylinder such that said hinge is rotatable with said coupler relative to each of said retractable piston and the first end of said back support to which said coupler is coupled for causing the opposite end of said back to rotate towards or away from the back of the user depending upon whether said hinge is rotating in said first or said opposite direction.

* * * * *